US008103030B2

(12) United States Patent
Barthel et al.

(10) Patent No.: US 8,103,030 B2
(45) Date of Patent: Jan. 24, 2012

(54) DIFFERENTIAL DIRECTIONAL MICROPHONE SYSTEM AND HEARING AID DEVICE WITH SUCH A DIFFERENTIAL DIRECTIONAL MICROPHONE SYSTEM

(75) Inventors: Roland Barthel, Erlangen (DE); Robert Bäuml, Eckental (DE); Eghart Fischer, Schwabach (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1127 days.

(21) Appl. No.: 11/977,111

(22) Filed: Oct. 23, 2007

(65) Prior Publication Data

US 2008/0212814 A1 Sep. 4, 2008

Related U.S. Application Data

(60) Provisional application No. 60/853,600, filed on Oct. 23, 2006.

(51) Int. Cl.
*H04R 25/00* (2006.01)

(52) U.S. Cl. ..... 381/313; 381/312; 381/318; 381/92

(58) Field of Classification Search ..... 381/313, 381/312, 318, 320, 92
See application file for complete search history.

(56) References Cited

U.S. PATENT DOCUMENTS

| | | | | |
|---|---|---|---|---|
| 6,584,009 | B1 | 6/2003 | Roehr et al. | |
| 7,209,568 | B2 * | 4/2007 | Arndt et al. | 381/313 |
| 2004/0240683 | A1 | 12/2004 | Niederdrank | |

FOREIGN PATENT DOCUMENTS

| | | | |
|---|---|---|---|
| DE | 103 31 956 | B3 | 1/2005 |
| DE | 103 10 579 | B4 | 6/2005 |
| DE | 10210779 | B4 | 4/2007 |
| EP | 0802699 | A2 | 10/1997 |
| EP | 1499160 | A2 | 1/2005 |

OTHER PUBLICATIONS

Communication from European Patent Office, Jul. 20, 2011, pp. 1-6.

* cited by examiner

*Primary Examiner* — Theresa T Doan

(57) ABSTRACT

A differential direction microphone system for a hearing aid device is described, comprising: a first directional microphone stage with a first differential directional microphone, and a second directional microphone stage with a further differential directional microphone, with the second directional microphone stage being connected downstream from the first directional microphone stage, where the directivity of the first directional microphone stage is essentially oriented in the opposite direction to the directivity of the second directional microphone stage, with the differential direction microphone system having a directional characteristic, of which the directivity is essentially orthogonal to an axis predetermined by the directivities of the first and the second directional microphone stage.

14 Claims, 4 Drawing Sheets

DIFFERENTIAL DIRECTIONAL MICROPHONE SYSTEM AND HEARING AID DEVICE WITH SUCH A DIFFERENTIAL DIRECTIONAL MICROPHONE SYSTEM

CROSS REFERENCE TO RELATED APPLICATIONS

The present application claims the benefit of the provisional patent application filed on Oct. 23, 2006 and assigned application No. 60/853,600, which is incorporated by reference herein in its entirety.

FIELD OF THE INVENTION

The invention relates to a differential directional microphone system for a hearing aid device, such as a hearing device or an active noise cancelling device for example, in which a lateral directional characteristic is created with the aid of coupled differential directional microphones. The invention further relates to a method for creating this lateral directional characteristic.

Modern hearing devices have audio processors which provide powerful processing and are trimmed for energy efficiency. These compensate for hearing loss by a signal level- and frequency-dependent gain. Current devices also possess powerful algorithms for reduction of feedback and ambient noise. An especially effective means for countering interference noise which is able to be localized are adaptive directional microphone algorithms. Especially powerful devices with superordinate classification systems can independently recognize important hearing situations and automatically select the best program for them. In this way they offer wearers optimum hearing and at the same time a high level of operating convenience.

Directional microphones have now become one of the established methods of reducing interference noise in hearing devices. With the aid of differential directional microphones the comprehensibility of speech can be demonstrably improved in hearing situations in which the useful signal and the interference signals are coming from different directions in the room. The directional effect is created by a differential processing of the output signals of two adjacent microphones with omnidirectional characteristics. The signal processing of a first-order differential directional microphone system essentially consists of the subtraction of the rear microphone signal delayed by a specific time from the front microphone signal. This produces a direction-dependent sensitivity, the characteristic of which can be adjusted by the delay time.

The strength of the directivity is qualified by a directivity Index, which in the case of a diffuse interference sound field and incidence of useful sound from the front direction specifies the improvements of the signal-to-noise ratio (SNR) in relation to an omnidirectional characteristic.

In particular because of their ability to save on resources when implemented in hearing devices, digital differential directional microphones employing two individual omnidirectional microphones are very popular. They have the characteristic of enabling sound from one direction of incidence to be filtered out. In such cases the preferred receive direction is typically implemented forwards (in the line of sight of the wearer) so that signals from behind are attenuated. Under some circumstances however it is desirable to dispense with the preferred direction. For example when traveling in a car it is sensible to maximize the directivity effect to the side since the driver, even when conversing with the passenger, must still be looking forwards, but at the same time a directional microphone is still desirable because of the interference noise.

With conventional hearing devices the directional microphones have previously been implemented without exception with a directivity oriented forwards. The reason for this is that differential directional microphones only allow what is referred to as an endfire arrangement, which means a maximum directivity forwards or backwards. In order to achieve a lateral directivity what is referred to as a beamformer has previously been needed which, as a "delay and sum" beamformer, possesses a small directivity with few microphones but also, as a so-called "Generalized Sidelobe Canceller" beamformer, involves a high level of effort because of its large filter length. Both aspects make the beamformer unattractive for hearing devices.

Furthermore second-order differential directional microphone systems are already known. In such cases the differential directional microphone principle is transferred to three microphones. This enhances the directivity of the microphone system. The receive direction of these known second-order differential directional microphones is similar to the receive direction of a first-order differential system, similarly pointing forwards (in the line of sight of the wearer). A second-order differential directional microphone system of this type is described for example in DE 10310579 B4 and DE 10331956 B3.

Adaptive directional microphone systems, which can adapt their directional characteristics continuously to the actual interference noise field for maximizing of the SNR gain in situations with directed noise incidence, are also realized in a few digital hearing devices. In this case, depending on the direction of incidence of the interference noise, the directional characteristic of the microphone system is continuously changed from a dipole via a hypercardioid to a cardioid.

SUMMARY OF THE INVENTION

The object of the invention is to provide a hearing aid device with a differential microphone system in which the lateral directivity is maximized. A further object of the invention is to provide a method with the aid of which the lateral directivity of a differential microphone system can be maximized. This object is achieved by a differential directional microphone system and by a hearing aid device as claimed in the independent claims. Further advantageous embodiments of the invention are specified in the dependent claims.

In accordance with the invention a differential directional microphone system is provided for a hearing aid device with a first directional microphone stage which features a first differential directional microphone and with a second directional microphone stage which features a further differential directional microphone, with the second directional microphone stage being connected downstream from the first directional microphone stage. In this case the directivity of the first directional microphone stage is essentially oriented in opposition to the directivity of the second directional microphone stage. The differential directional microphone system in this case has a directional characteristic of which the directivity is essentially orthogonal to an axis predetermined by the directivities of the first and the second directional microphone stage. The opposed orientation of the directivity of the differential directional microphones connected behind each other allows a lateral directional characteristic to be generated in an especially simple manner with a zero point in the forwards direction and the backwards direction in each case.

In an advantageous embodiment of the invention there is provision for the first directional microphone stage to feature a second differential directional microphone of which the directivity corresponds essentially to the directivity of the first differential directional microphone, with the output signals of the first and the second differential directional microphone serving as input signals for the further differential directional microphone. Through this arrangement the signal components from the forwards and the backwards direction are attenuated especially effectively. By explicitly connecting three or four omnidirectional microphones by means of three differential directional microphone circuits the directivity in a broadfire arrangement can be achieved.

In a further advantageous embodiment of the invention there is provision for the first directional microphone stage to feature three microphones. In this case the first differential directional microphone features a first circuit block, the inputs of which are connected to the first and the second microphone, while the second differential directional microphone features a second circuit block, the inputs of which are connected to the second and the third microphone. The directivity of the second differential directional microphone corresponds in this case to the directivity of the first differential directional microphone. In this arrangement the second microphone will be jointly used by the first and the second differential microphone. Since only three microphones are used the corresponding differential directional microphone can be implemented in a simple manner.

A further advantageous embodiment of the invention provides for the second microphone to be arranged equidistantly from the first and the third microphone. The equidistant arrangement of the microphones allows an especially effective lateral directivity of the differential directional microphone.

In a further advantageous embodiment of the invention the second microphone is essentially arranged on the axis predetermined by the position of the first and third microphone. The arrangement of the microphones along the predetermined axis also allows an especially effective lateral directivity of the differential directional microphone.

In accordance with further advantageous embodiment of the invention there is provision for the first circuit block to be embodied to delay the microphone signal of the second microphone by a predetermined time, to subtract the delayed microphone signal of the second microphone and also the microphone signal of the first microphone from each other and to output the resulting signal as an output signal to a signal output of the first differential directional microphone. The second circuit block is also embodied to delay the microphone signal of the third microphone by a predetermined time, to subtract the delayed microphone signal of the third microphone and also the microphone signal of the second microphone from each other and to output the resulting signal as an output signal at a signal output of the second differential directional microphone. Furthermore the further differential directional microphone features a further circuit block with a first signal input for the output signal of the first differential directional microphone and a second signal input for the output signal of the second differential directional microphone. The further circuit block is embodied in this case to delay the output signal of the first differential directional microphone by a predetermined time and to subtract from each other the delayed output signal of the first differential directional microphone and the output signal of the second differential directional microphone. This specific layout allows the directivity of the two differential directional microphones to be determined by selecting the appropriate delay times.

In a further advantageous embodiment of the invention there is provision for the first, the second and the third circuit block to each feature a delay element, with the delay element been embodied to delay the corresponding signals by a time which corresponds to the delay time needed by a sound signal to travel a distance which corresponds to the distance between the first and the second microphone or between the second and the third microphone. It is advantageous in this case that the directivities of the two directional microphone stages are oriented precisely opposite to each other by the specifically defined delay time. Since in this case the zero points of the two differential microphones are also oriented precisely opposite each other, a high lateral directivity can be achieved in this way.

Furthermore an especially advantageous embodiment of the invention makes provision for the first directional microphone stage to feature four microphones with the first differential directional microphone comprising the first and the second microphone as well as a first circuit block, and with the second differential directional microphone comprising the third and the fourth microphone as well as a second circuit block. The directivity of the second differential directional microphone corresponds in this case to the directivity of the first differential directional microphone. The arrangement with four microphones represents an alternate embodiment to the arrangement with three microphones. It allows a greater variation in relation to the geometrical arrangement of the microphones.

In a further advantageous embodiment there is provision for the four microphones to essentially be arranged along an axis, with the distance between the first and the second microphone essentially corresponding to the distance between the third and fourth microphone. The arrangement of the microphones along an axis allows a better lateral directivity.

In a further advantageous embodiment of the invention there is provision for the first circuit block to be embodied to delay the microphone signal of the second microphone by a first predetermined time and to subtract the delayed microphone signal of the second microphone and the microphone signal of the first microphone from each other. Furthermore the second circuit blocking is embodied to delay the microphone signal of the fourth microphone by the first predetermined time and to subtract the delayed microphone signal of the fourth microphone and also the microphone signal of the third microphone from each other. Finally the further differential directional microphone features a further circuit block to delay the output signal of the first differential directional microphone by a second predetermined time and to subtract the delayed output signal of the first differential directional microphone and also the output signal of the second differential directional microphone from each other. This embodiment exhibits a very simple structure which can advantageously be implemented in a very simple manner.

In a further advantageous embodiment of the invention there is provision for the first, the second and the third circuit block to each feature a delay element, with the first and the second delay element being embodied to delay the corresponding signals by a time which corresponds to the delay time needed by a sound signal to travel the distance which corresponds to the distance between the first and the second microphone or between the third and the fourth microphone. In this case the second delay time corresponds to a signal delay which a sound signal needs to travel a distance which corresponds to a combination of the distance between the first and the second microphone or between the third and fourth microphone and the distance between the second and third microphone. The delayed time determined in this way advantageously allows an optimum lateral directivity of the differential directional microphone system.

Finally a further advantageous embodiment of the invention makes provision for the directional characteristic of the differential directional microphone system to be able to be adaptively modified. This would advantageously allow an adaptation of the directional characteristics to different hearing situations.

BRIEF DESCRIPTION OF THE DRAWINGS

The invention is explained below in greater detail with reference to drawings. The figures show.

DETAILED DESCRIPTION OF THE INVENTION

Figure 1:
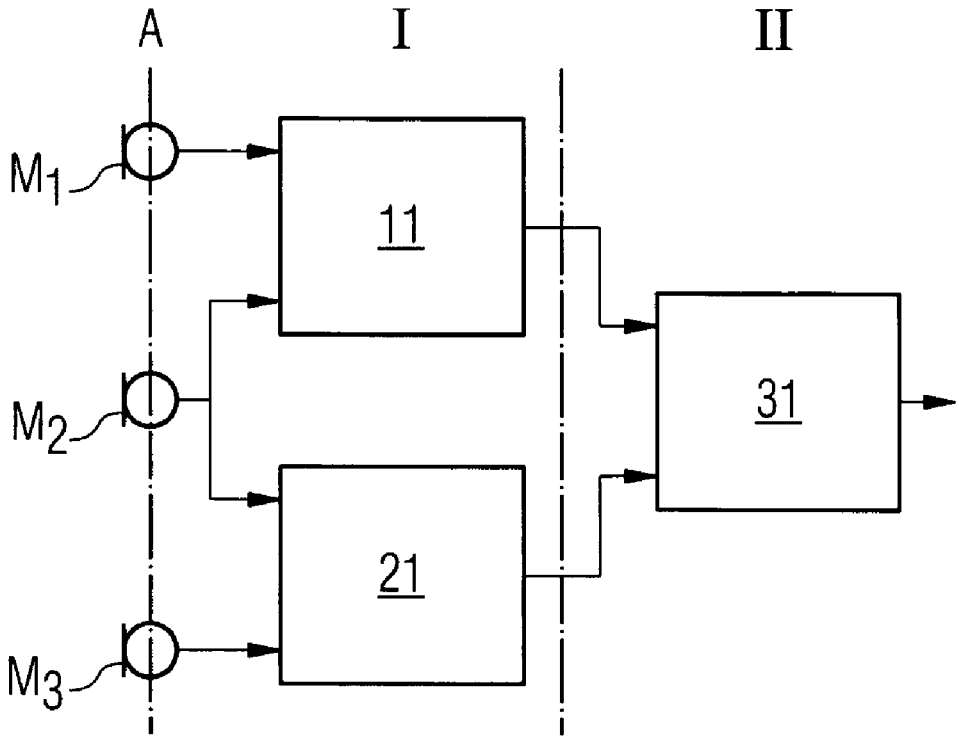
FIG. 1 a second-order differential directional microphone system with three differential directional microphones connected to each other.

FIG. 1 shows a second-order differential directional microphone system as typically already used today for noise cancellation. The differential directional microphone system is constructed in two stages and features three microphones M1, M2, M3 which are typically arranged along a straight line (microphone axis A). The first microphone stage I is formed in this case by two differential directional microphones 10, 20. Each of the two differential directional microphones 10, 20 in their turn is made up of two of the three input microphones M1, M2, M3 and a first circuit block 11 and a second circuit block 21. In such a circuit block the signals of the two input microphones M1, M2, M3 are combined in a typical way with each other and applied to the output of the relevant differential directional microphone 10, 20. The output signals of the two differential directional microphones 10, 20 of the first microphone stage I form the two input signals of the differential directional microphone 30 of the second microphone stage. After processing in the further circuit block 31 of the differential directional microphone 30 of the second microphone stage II, in which the two input signals are combined with each other in a typical way, an output signal is output for further processing at the output of the second microphone stage II. Such differential directional microphone systems are used to amplify the directivity forwards, meaning in the line of sight of the corresponding hearing aid wearer and to filter out lateral interference noise. The directivity of the first directional microphone stage is amplified by the second directional microphone stage II so that lateral ambient noises are attenuated more strongly. The output signal of the second microphone stage II of the conventional second-order differential directional microphone system thus features no components for only very small components from the lateral direction, i.e. from the 90° or 270° direction.

Figure 2:
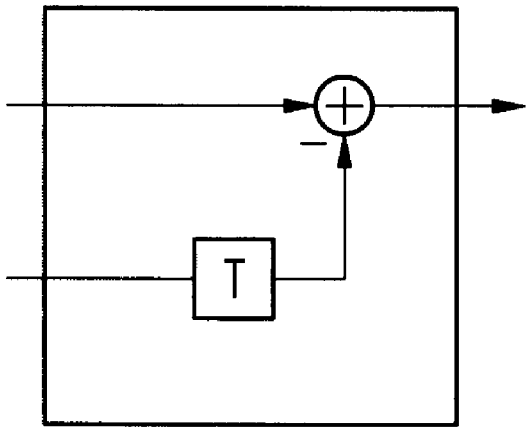
FIG. 2 the internal structure of a circuit block of a differential directional microphone.

FIG. 2 shows schematically the typical structure of a circuit block of such a differential directional microphone. In this case a first input signal present at the input of the respective circuit block is first delayed with the aid of a delay element by a predetermined time T. The delayed signal is then subsequently subtracted with the aid of an adder from the second input signal. The combined signal is finally output at the signal output of the circuit block. In this case the signal of the first microphone M1 can basically be subtracted from the signal of the delayed signal of the second microphone M2. The delay time T set determines in this case the direction from which the respective differential directional microphone preferably receives sound signals.

Figure 3:
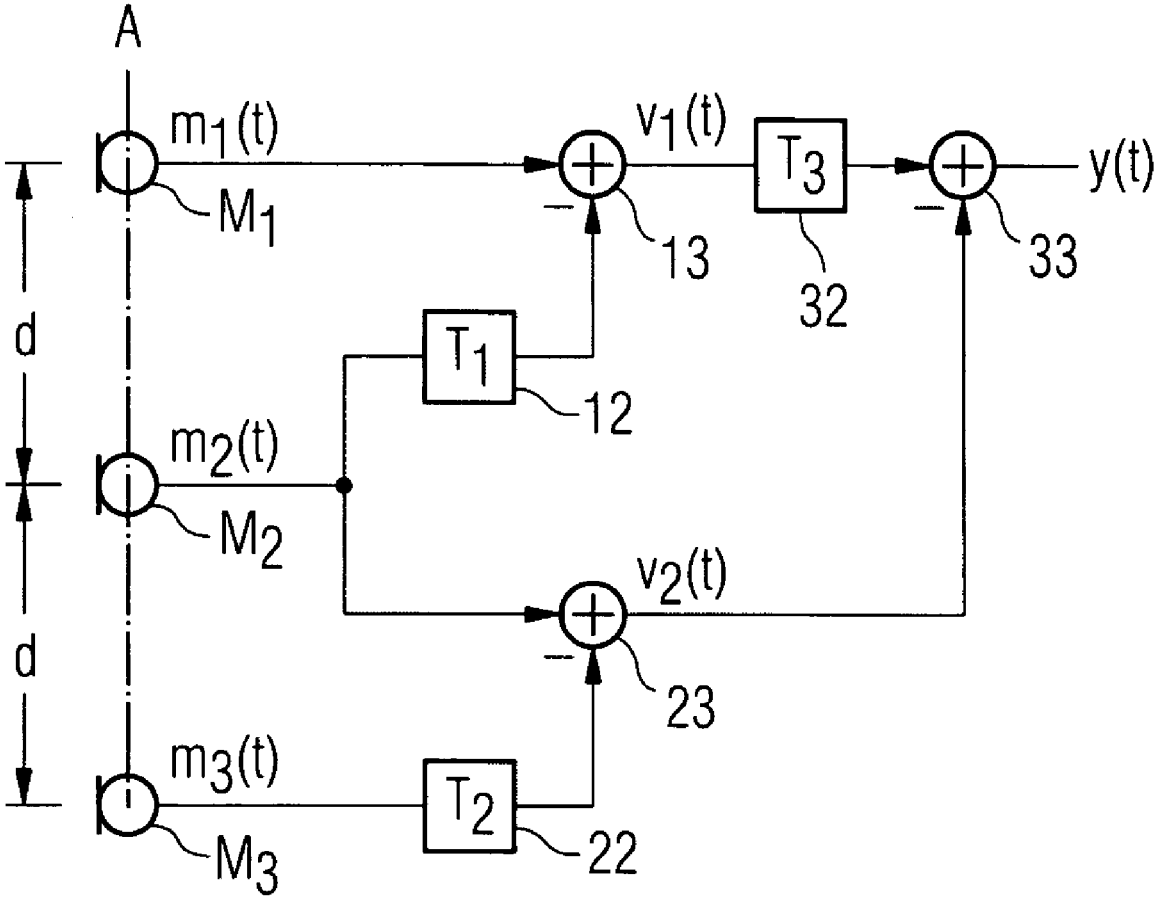
FIG. 3 a second-order differential directional microphone system as claimed in the invention with three omnidirectional microphones.

To achieve a lateral directivity (broadfire arrangement) the circuits of the differential microphone system will now be designed so that the directivity of the two directional microphone stages I, II are oriented in opposition. Thus the first stage I filters out sound from the backwards direction while the second stage II filters out sound from the forwards direction. The result is a directivity in a broadfire application. The corresponding structure of such a second-order differential directional microphone system is shown in an example in FIG. 3. In this case the three microphones assigned to the first directional microphone stage I are preferably arranged precisely along at the microphone axis A. The second microphone M2 is further arranged equidistant from the first and from the third microphone M1, M3. This is illustrated in FIG. 3 by the corresponding indication of the microphone distances d. The output signals $m_1(t)$, $m_2(t)$, $m_3(t)$ of the three microphones M1, M2, M3 directional microphones 10, 20 of the first directional microphone stage I with the second microphone M2 being assigned to the first and the second differential microphone at 10, 20 respectively. To achieve a directivity with a zero point behind, a time $T_0$ is selected as the delay time $T_1$ of the first delay element 12 which corresponds to the signal delay of a sound wave for the distance predetermined by the microphone distance d. The signals of the first to second microphone M1, M2 are then subsequently combined with one another with the aid of an adder 13. In this case the delayed microphone signal $m_2(t-T_0)$ of the second microphone M2 is subtracted from the microphone signal $m_1(t)$ of the first microphone M1. With the second differential directional microphone 20 too the time $T_0$ is selected as the delay time $T_2$ of the corresponding delay element 22 in order to achieve a directivity with a rear zero point. Subsequently the delayed microphone signal $m_3(t-T_0)$ of the third microphone M3 is subtracted with the aid of an adder 23 from the microphone signal $M_2(t)$ of the second microphone. Since the two differential directional microphones 10, 20 of the first microphone stage I have a zero point in the forwards direction and a directivity forwards, the result is an overlaying of their cardioid sphere.

The output signals $V_1(t)$, $v_2(t)$ of the two differential directional microphones form two input signals for the differential directional microphone 30 of the second microphone stage II. To achieve the desired directivity, in a similar way to the two differential directional microphones 10, 20 of the first microphone stage, one of the input signals is delayed with the aid of a corresponding delay element 32 by a predetermined delay time $T_3$ and the signals are subsequently combined with each other the aid of an adder 33. In this case the output signal $v_1(t)$ of the first differential directional microphone 10 is delayed by a time $T_0$ and the output signal $v_2(t)$ of the second differential directional microphone 20 is subsequently subtracted from the delayed output signal $v_1(t-T_0)$ of the first differential directional microphone 10. In this way the differential directional microphone 30 of the second microphone stage II, which has cardioid directional characteristic, is given a zero point in the backwards direction.

This also follows from analysis of the network. The following then applies for the output signal from the differential directional microphone system:

$$y(t)=m_1(t-T_0)-m_2(t-2T_0)-m_2(t)+m_3(t-T_0)$$

For signals from behind the following applies:

$$m_3(t)=m_2(t+T_0)=m_1(t+2T_0)$$

For signals from the front the following accordingly applies:

$$m_1(t)=m_2(t+T_0)=m_3(t+2T_0)$$

if $T_0$=d/c is selected as delay time (microphone distance d, sound speed c), the following equation is produced for the proportions of the output signal of the differential microphone system from the forwards and the backwards direction:

$$y(t)=0$$

Since the two microphone stages I, II each have zero points in an opposing direction the output signal of the differential microphone system thus does not contain any components from the forwards and backwards direction. A side directivity is thus achieved by the combination the two microphone stages I, II.

To achieve the desired lateral directivity of the differential microphone system it is however not absolutely necessary for the second microphone M1 to be arranged directly on the microphone axis A forming the shortest connection between the first and the third microphone M1, M3. Instead the deciding factor for the resulting lateral directivity of the differential directional microphone system is that the projections of the connection path between the first and the second microphone M1, M2 and the path between the second and third microphone M2, M3 in relation to the microphone axis A are of the same length. Thus it is basically possible with a triangular arrangement of the three microphones M1, M2, M3 to achieve a corresponding side directivity provided the distances d of the two microphone pairs M1, M2 and M2, M3 at the same value in relation to the predetermined axis A.

Figure 4A:
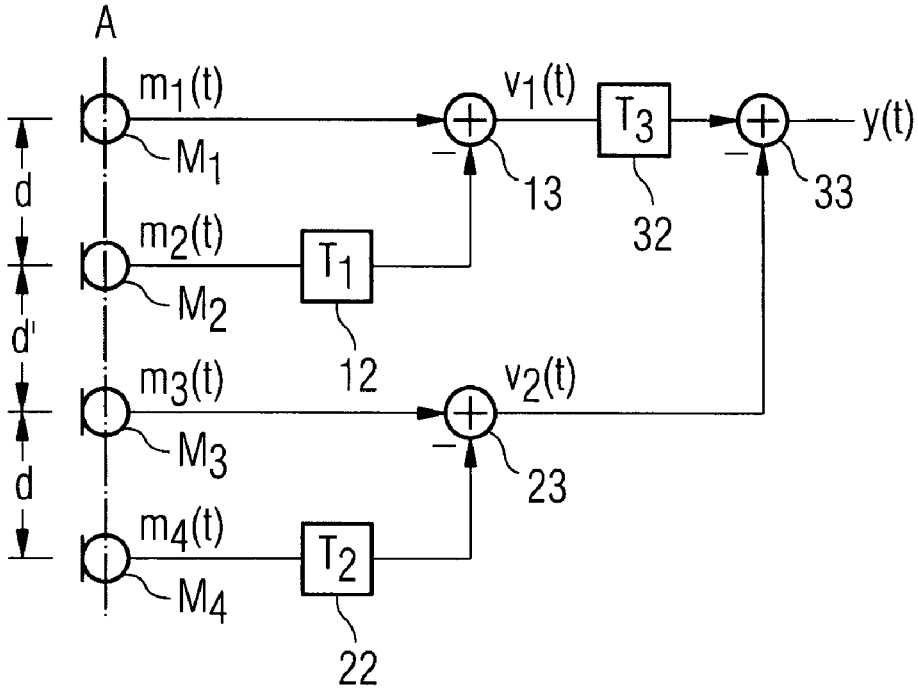
FIGS. 4A and 4B two variants of a second-order differential directional microphone system as claimed in the invention with four omnidirectional microphones.

FIG. 4A shows a further exemplary embodiment of the inventive differential microphone system. In this case the first microphone stage I comprises four omnidirectional microphones M1, M2, M3, M4, which are preferably arranged along the microphone axis A. The first and the second microphone M1, M2 as well as the third and the fourth microphone M3, M4, each of which form a microphone pair in this case, have a predetermined distance d from each other. The distance d' between the second and the third microphone M2, M3 also corresponds in FIG. 4A to the regular microphone distance d. However this distance d' can be varied if required. To obtain the desired directional characteristic the delay time $T_3$ of the delay element 32 of the further differential directional microphone 30 must then be specifically adapted.

This delay time $T_3$ will be set in this case as a function of the distance d' of the second and of the third microphone M2, M3. The relationship between the distance d' of the second and of the third microphone M2, M3 and the necessary delay time $T_3$ of this delay element 32 can be represented as follows:

$$T_3=T_0+d'/d*T_0=(1+d'/d)*T_0$$

Since in the example shown in FIG. 4 the distance d' between the second and the third microphone M2, M3 corresponds to the regular microphone distance d, double the delay time $T_0$ will be selected for the delay time $T_3$ of the delay element 32 of the further differential directional microphone 30, in order to achieve a directivity oriented orthogonally to the microphone axis A with a zero point in the forwards and backwards direction respectively (broadfire arrangement).

Provided the distance d' between the second and the third microphone M2, M3 is reduced to zero, the position of the second microphone M2 along at the microphone axis A coincides with the corresponding position of the third microphone M3. In this case a single microphone can be used instead of two separate microphones. Such an arrangement then corresponds to the differential microphone system shown in FIG. 3. Since the distance d' between the second and the third microphone M2, M3 is zero, the above-mentioned equation for the delay element 32 of the second directional microphone stage II delivers a delay time $T_3$ of precisely $T_0$.

Figure 4B:
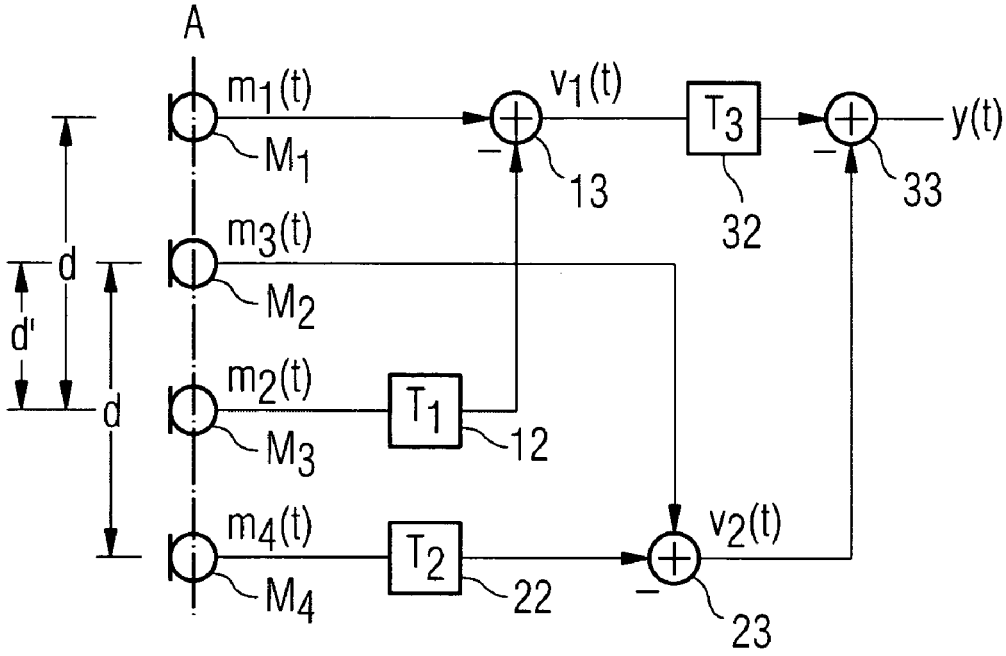

The arrangement of the two microphone pairs of the first and the second differential directional microphone 10, 20 can however also intersect. As is shown in FIG. 4B, the second microphone M2 of the first differential microphone 10 is then located between the third and the fourth microphone M3, M4 of the second differential microphone 20. In this case too the delay time $T_3$ of the second directional microphone stage II can be defined on the basis of the relationship underlying the equation specified above between delay time and microphone distance. However it must be taken into account in this case that the path from the second to the third microphone M2, M3 now runs in the opposite direction to the path from the first to the second or from the third to the fourth microphone M3, M4. This thus produces the following equation for the delay time $T_3$ of the second directional microphone stage II in such an arrangement:

$$T_3=T_0-d'/d*T_0=(1-d'/d)*T_0$$

Since in the present example the distance d' between the second and the third microphone M2, M3 is exactly half the regular microphone distance d, exactly $T_0/2$ is produced from the above equation as a value for the delay time $T_3$ of the second directional microphone stage. Expressed in other words the delay times T1, T2 of the first directional microphone stage I are twice as long as the delay time of the second directional microphone stage II.

The arrangement of the microphone pairs of the two differential directional microphones 10, 20 in relation to each other can thus be varied in any way required along the microphone axis A. With the aid of the relationships illustrated between the microphone distances d, d' and the delay times $T_1$, $T_2$, $T_3$ of the two microphone stages I, II the circuit of the differential directional microphone at system can be adapted in each case so that the desired directional characteristic is produced.

In the examples shown in FIGS. 3, 4A and 4B the combination of the signals in the adders of the corresponding circuits can basically also be undertaken in the opposite directions so that for example for the circuit shown in FIG. 3 it is not the Delayed output signal M2($t-T_0$) of the second microphone M2 which is subtracted from the output signal m(t) of the first microphone M1 but the other way round. In this case the subtraction of the corresponding microphone signals $m_3(t-T_0)$, $m_2(t)$ in the second differential directional microphone 20 or of the signals $v_1(t)$, $v_2(t-T_0)$ in the further differential directional microphone 30 must also be undertaken accordingly.

Figure 5:
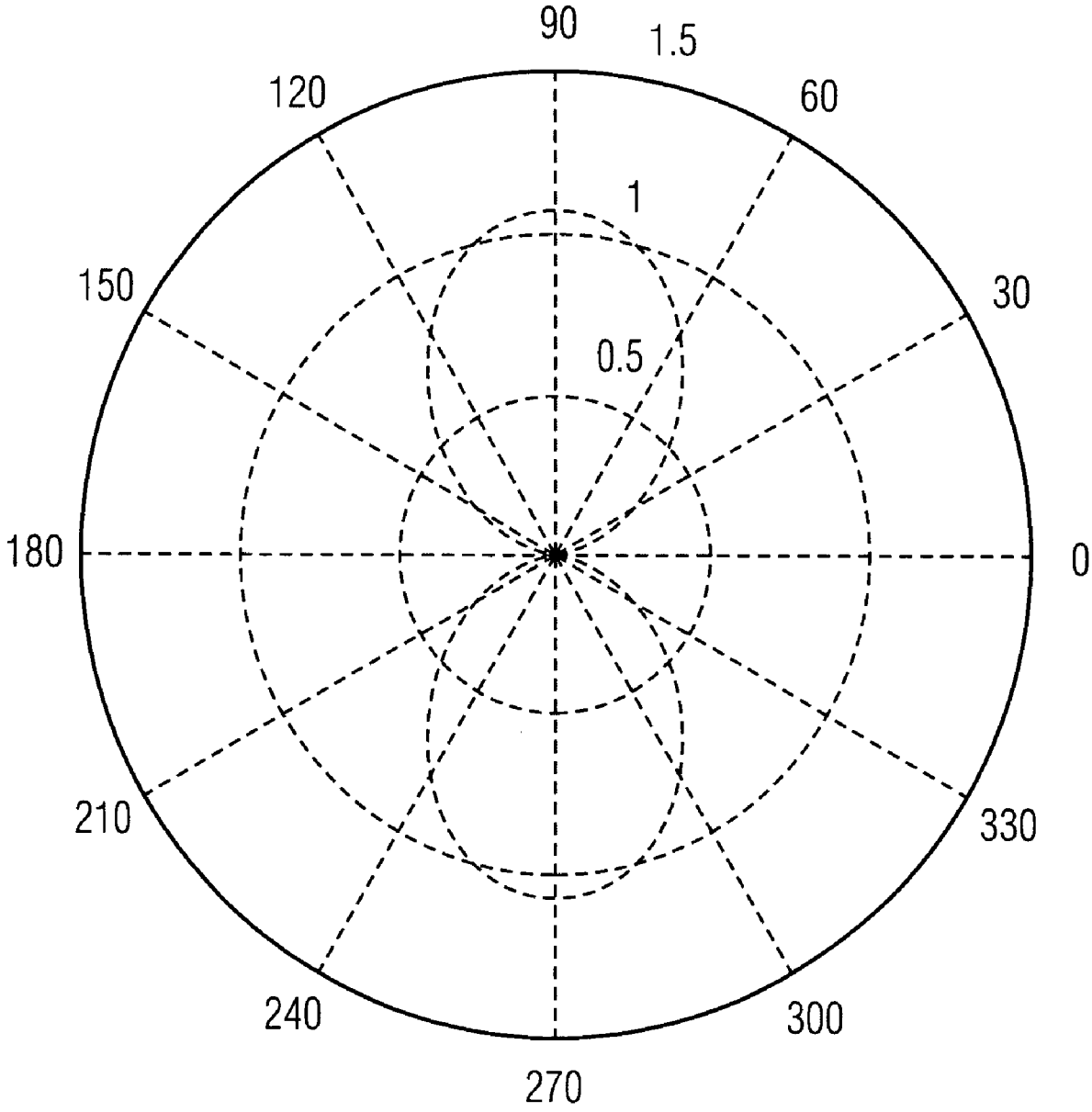
FIG. 5 a polar diagram to show the directional characteristic of the inventive second-order differential microphone system.

FIG. 5 shows the directional characteristic of the invented differential microphone system with an arrangement of three omnidirectional microphones from FIG. 3 as a polar diagram. The directional characteristic describes the sensitivity of the differential microphone system others and output signal level depending on the angle of incidence of the sound. In this case the forwards direction of the axis A described by the microphone arrangement, i.e. the line of sight of the hearing aid wearer, is 0°. Accordingly the backwards direction is at 180°. The angles of 90° or 270° correspond to the left or right side of the hearing aid wearer. As can be seen from the polar diagram recorded in a horizontal plane, the zero points of the differential microphone system lie at 0° and at 180°. By contrast the maxima lie in the direction 90° and 270°, i.e. orthogonal to the forwards-backwards axis. This corresponds to what is referred to as a broadfire arrangement.

All embodiments of the invention are able to be implemented by both analog and digital systems. In a differential microphone system which operates digitally the microphone signals which may be present in analog form must first be digitized before they can be further processed. The delaying and subtraction of the signals can in such cases be realized by means of hardware and software.

Basically the distances d or d' specified here always relate to a path along the microphone axis A. Provided the microphones M1, M2, M3, M4, especially the second microphone M2 in the 3-microphone arrangement or the second or third microphone M2, M3 respectively in the 4-microphone arrangement lie precisely on the microphone axis, the microphone distance d or d' preferably means the projection of the connecting paths between the respective microphones on the microphone axis A.

The invention claimed is:

1. A differential directional microphone system for a hearing aid device, comprising:

a first differential directional microphone in a first directional microphone stage having a directional characteristic with a zero point in a first direction; and a further differential directional microphone in a second directional microphone stage connected downstream from the first directional microphone stage having a directional characteristic with a zero point in a second direction oriented opposite to the first direction, wherein the first directional microphone stage comprises a second differential directional microphone that has a directivity essentially corresponding to a directivity of the first differential directional microphone, wherein the further differential directional microphone is connected downstream to the first and the second differential directional microphones, wherein the first directional microphone stage comprises a first microphone, a second microphone and a third microphone, wherein the first differential directional microphone comprises the first and the second microphones and features a first circuit block, wherein the second differential directional microphone comprises the second and the third microphones and features a second circuit block, and wherein the directivity of the second differential directional microphone corresponds to the directivity of the first differential directional microphone.

2. The differential directional microphone system as claimed in claim 1, wherein the second microphone is arranged equidistant from the first and the third microphones.

3. The differential directional microphone system as claimed in claim 1, wherein the second microphone is arranged on an axis predetermined by a position of the first microphone and a position of the third microphone.

4. The differential directional microphone system as claimed in claim 1, wherein the first circuit block:

delays a microphone signal of the second microphone by a first predetermined time, subtracts the delayed microphone signal of the second microphone and a microphone signal of the first microphone from each other, and outputs a result of the subtraction as an output signal of the first differential directional microphone, and wherein the second circuit block:

delay a microphone signal of the third microphone by the first predetermined time, subtracts the delayed microphone signal of the third microphone and the microphone signal of the second microphone from each other, and outputs a result of the subtraction as an output signal of the second differential directional microphone, wherein the further differential directional microphone features a further circuit block connected downstream to the first and the second differential directional microphones, and wherein the further circuit block:

delays the output signal of the first differential directional microphone by the first predetermined time, subtracts the delayed output signal of the first differential directional microphone and the output signal of the second differential directional microphone from each other.

5. The differential directional microphone system as claimed in claim 4, wherein the first circuit block features a first delay element, wherein the second circuit block features a second delay element, wherein the further circuit block features a further delay element, and wherein the first predetermined time is a delay time needed by a sound signal for a path corresponding to a distance between the first and the second microphones or between the second and the third microphones.

6. The differential directional microphone system as claimed in claim 1, wherein the first directional microphone stage further comprises a fourth microphone, wherein the first differential directional microphone comprises the first and the second microphone and features the first circuit block, with the second differential directional microphone comprises the third and the fourth microphone and features the second circuit block, and wherein the directivity of the second differential directional microphone corresponds to the directivity of the first differential directional microphone.

7. The differential directional microphone system as claimed in claim 6, wherein the first microphone, the second microphone, the third microphone and the fourth microphone are omnidirectional microphones.

8. The differential directional microphone system as claimed in claim 6, wherein the first microphone, the second microphone, the third microphone and the fourth microphone are arranged along an axis with a distance between the first and the second microphones corresponding to a distance between the third and the fourth microphones.

9. The differential directional microphone system as claimed in claim 6, wherein the first circuit block:

delays a microphone signal of the second microphone by a first predetermined time, subtracts the delayed microphone signal of the second microphone and a microphone signal of the first microphone from each other, and outputs a result of the subtraction as an output signal of the first differential directional microphone, wherein the second circuit block:

delays a microphone signal of the fourth microphone by the first predetermined time, subtracts the delayed microphone signal of the fourth microphone and the microphone signal of the second microphone from each other, and outputs a result of the subtraction as an output signal of the second differential directional microphone, wherein the further differential directional microphone features a further circuit block connected downstream to the first and the second differential directional microphones, and wherein the further circuit block:

delays the output signal of the first differential directional microphone by a second predetermined time, subtracts the delayed output signal of the first differential directional microphone and the output signal of the second differential directional microphone from each other.

10. The differential directional microphone system as claimed in claim 9, wherein the first circuit block features a first delay element, wherein the second circuit block features a second delay element, wherein the further circuit blocks features a further delay element, wherein the first predetermined time is a delay time needed by a sound signal for a distance d between the first and the second microphones or between the third and the fourth microphones, wherein the second predetermined time is a delay time needed by a sound signal for a distance combining the distance d between the first and the second microphone or the distance between the third and the fourth microphone and a distance d' between the second and the third microphones.

11. The differential directional microphone system as claimed in claim 10, wherein the second microphone is arranged between the first and the third microphones and the third microphone is arranged between the second and the fourth microphones, and wherein the second predetermined time $T_3$ is a function of the first predetermined time $T_0$ by an equation of:

$$T_3=(1+d'/d)*T_0.$$

12. The differential directional microphone system as claimed in claim 10, wherein the second microphone is arranged between the third and the fourth microphones and the third microphone is arranged between the first and the second microphones, and wherein the second predetermined time $T_3$ is a function of the first predetermined time $T_0$ by an equation of:

$$T_3=(1-d'/d)*T_0.$$

13. The differential directional microphone system as claimed in claim 1, wherein a directional characteristic of the differential directional microphone system is modified adaptively.

14. A hearing aid device with a second-order differential directional microphone system, comprising:

a first differential directional microphone in a first directional microphone stage having a directional characteristic with a zero point in a first direction; and a further differential directional microphone in a second directional microphone stage connected downstream from the first directional microphone stage having a directional characteristic with a zero point in a second direction oriented opposite to the first direction, wherein the first directional microphone stage comprises a second differential directional microphone that has a directivity essentially corresponding to a directivity of the first differential directional microphone, wherein the further differential directional microphone is connected downstream to the first and the second differential directional microphones, wherein the first directional microphone stage comprises a first microphone, a second microphone and a third microphone, wherein the first differential directional microphone comprises the first and the second microphones and features a first circuit block, wherein the second differential directional microphone comprises the second and the third microphones and features a second circuit block, and wherein the directivity of the second differential directional microphone corresponds to the directivity of the first differential directional microphone.

* * * * *